US005498386A

United States Patent [19]

Lin et al.

[11] Patent Number: 5,498,386

[45] Date of Patent: Mar. 12, 1996

[54] METHOD FOR PREPARING COLORED POLYAMIDE FIBERS WHICH CONTAIN POLYCARBONATES

[75] Inventors: Perry H. Lin, Seaford; Yanhui Sun, Greenville, both of Del.

[73] Assignee: E. I. Du Pont de Nemours and Company, Wilmington, Del.

[21] Appl. No.: 214,335

[22] Filed: Mar. 16, 1994

[51] Int. Cl.[6] ..... D01F 1/04

[52] U.S. Cl. ..... 264/211; 525/433; 525/467

[58] Field of Search ..... 264/78, 151, 168, 264/176.1, 211; 525/433, 467

[56] References Cited

U.S. PATENT DOCUMENTS 3,210,438 10/1965 Chapman ..... 525/433
3,225,114 12/1965 Chapman ..... 525/467
3,810,876 5/1974 Cowell et al. ..... 525/420
5,108,684 4/1992 Anton et al. ..... 264/176.1

FOREIGN PATENT DOCUMENTS 944744 12/1963 United Kingdom .

OTHER PUBLICATIONS

Translation of Japan 62–28,203 (published Jun. 18, 1987).

*Primary Examiner*—Leo B. Tentoni

[57] ABSTRACT

This invention relates to an improved process for making colored polyamide fibers. The process involves adding about 0.1 to about 3.0 weight percent polycarbonate to a polyamide melt prior to extruding the melt through a spinneret to make colored fibers. The invention also encompasses the resultant fibers.

7 Claims, 2 Drawing Sheets

METHOD FOR PREPARING COLORED POLYAMIDE FIBERS WHICH CONTAIN POLYCARBONATES

FIELD OF THE INVENTION

This invention relates to an improved process for making colored polyamide fibers and the resultant fibers. The process involves adding a polycarbonate to the polyamide melt prior to extruding the melt through a spinneret to form fibers.

BACKGROUND OF THE INVENTION

Today, fiber producers often use a method known as solution dyeing to make "colored" nylon fibers. By the term, "colored" as used herein, it is meant a positive colorant value conferred by colored pigments and excludes the sole use of whitening agents such as $TiO_2$ and filler materials such as talc or clay. This solution dyeing method may involve blending one or more pigments directly with the nylon fiber-forming polymer and then extruding the blend through a spinneret to make colored fibers. Alternatively, a color concentrate containing one or more pigments dispersed in a polymer matrix and also containing such additives as lubricants and delustering agents ($TiO_2$) may first be prepared. The color concentrate is then blended with the nylon fiber-forming polymer and the blend is spun into colored fibers. For example, Anton, U.S. Pat. No. 5,108,684 involves a process where pigments are dispersed in a terpolymer of nylon 6/6,6/6,10 and pigmented pellets of the terpolymer are formed. These pellets are then remelted or "let-down" in an equal or greater amount of nylon 6, mixed thoroughly to form a uniform dispersion, resolidified, and pelletized. The resulting color concentrate is then blended with a nylon copolymer containing an aromatic sulfonate or an alkali metal salt thereof. The melt-blend is then spun to form stain-resistant, pigmented fibers.

Now, it has been found that some pigments which are introduced in neat (non-diluted) form, as described above, cause the molten polyamide to depolymerize somewhat. This causes a drop in the polymer melt viscosity which adversely affects the melt spinning process by increasing the number of filament spinning breaks and changing the cross-sectional shape of non-round filaments. In some instances, there are also problems in the spinning operation if the pigment is introduced in the form of a color concentrate. Particularly, the low molecular weight, low melt viscosity polyamide introduced with the pigment may cause the overall polymer melt viscosity to decrease sufficiently to cause spinning breaks.

In view of the foregoing, it would be desirable to have a method for introducing pigments into polyamide fibers without adversely affecting the melt spinning process. The present invention provides such a method along with the resultant fibers.

SUMMARY OF THE INVENTION

This invention provides an improved process for producing colored nylon fiber. Generally, the process involves forming a fiber-spinnable melt blend comprising nylon polymer, pigment, and about 0.1 to about 3.0 weight percent polycarbonate based on the weight of the melt blend. The melt blend is extruded through a spinneret to form colored nylon fiber. Preferably, the nylon polymer is selected from the group consisting of nylon 6,6 or nylon 6 homopolymer or copolymers thereof, sulfonated nylon 6,6 or nylon 6 copolymer containing units derived from an aromatic sulfonate or an alkali metal salt thereof, and nylon 6,6 or nylon 6 copolymer containing units derived from 2-methyl-pentamethylenediamine and isophthalic acid. Preferably, a nylon 6,6 copolymer containing about 1.0 to about 4.0 weight percent units derived from the sodium salt of 5-sulfoisophthalic acid is used.

The pigment may be added to the nylon polymer melt in neat form, as mixture with additives, or in the form of a color concentrate. The color concentrate may contain pigments dispersed in a nylon polymer matrix such as, but not limited to, nylon 6 or a terpolymer of nylon 6,6/6,10.

The polycarbonate may be added to the nylon polymer melt in neat form, as a mixture with pigments or additives, or in the form of a concentrate comprising polycarbonate dispersed in a nylon polymer matrix. The polycarbonate concentrate may also include pigments dispersed in the polymer matrix.

This invention also includes fibers made from the above process, preferably nylon 6,6 copolymer fibers containing units derived from the sodium salt of 5-sulfoisophthalic acid. The fibers may be bulked continuous filaments or staple fiber.

DETAILED DESCRIPTION OF THE INVENTION

Figure 1:
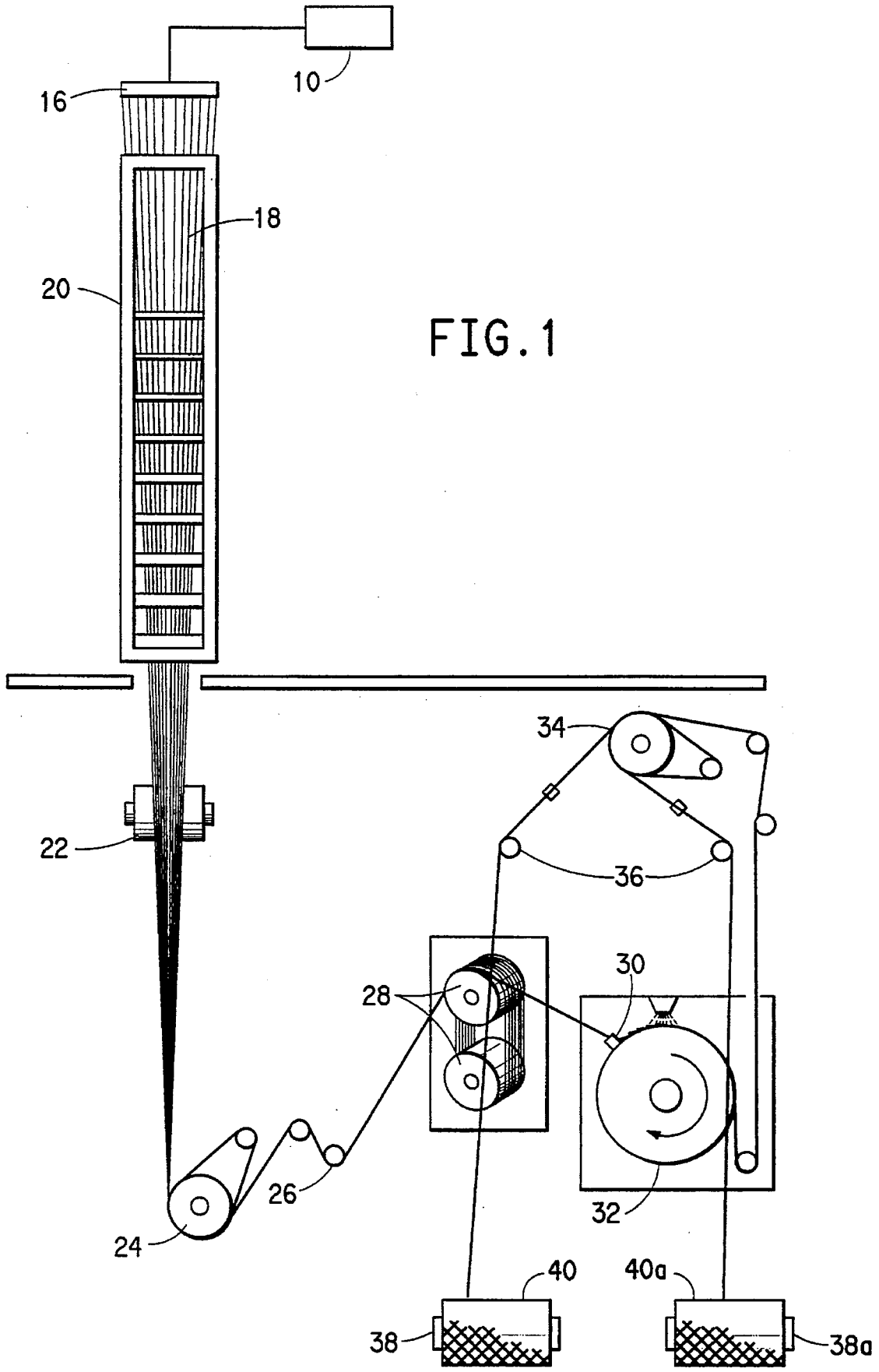
FIG. 1 is a schematic illustration of the process of this invention, wherein polycarbonate is fed into the extruder.

FIG. 1 shows a process for making colored nylon fibers of this invention, wherein polyamide flake is fed into extruder 10 along with polycarbonate and colored pigment. The blend is then melted and pumped through spinneret 16. Fibers 18 emerge from the spinneret into quench chimney 20 where cooling air is blown past the hot fibers. The fibers 18 are pulled through the quench zone by means of a puller or feed roll 24. After quenching, the fibers are treated with a spin-draw finish by contacting a finish applicator 22.

Next, the filaments pass around feed roll 24 from where the yarn is drawn over a pair of heated draw rolls 28. The resulting fiber may be crimped and cut into staple fiber or bulked to make bulked continuous filament (BCF). For BCF, the fiber is heated and advanced for bulking by hot air jet 30 of the type described in Breen and Lauterbach, U.S. Pat. No. 3,186,155. The hot fluid exhausts with the threadlines against a rotating drum 32 having a perforated surface, on which the yarns are cooled to set the crimp. From the drum 32, the threadlines pass to a driven take-up roll 34, over secondary finish applicators 36 onto rotating cores 38 and **38*a* to form packages 40 and 40*a***.

As shown in FIG. 1, fiber-forming nylon polymer is fed into extruder 10. Suitable fiber-forming nylon polymers for use in this invention include, but are not limited to, nylon homopolymers such as polyhexamethylene adipamide (nylon 6,6) and polycaprolactam (nylon 6) and copolymers thereof, i.e., nylon 6,6/nylon 6, and other nylon copolymers such as copolyamides containing hexamethylene adipamide units and units derived from an aromatic sulfonate or alkali salt thereof such as the sodium salt of 5-sulfoisophthalic acid, 2-methylpentamethylenediamine (MPMD), N,N-dibutylhexamethylenediamine, caprolactam, dodecanedioic acid, isophthalic acid, terephthalic acid or combinations thereof. These copolymers may be true copolymers (random or block) or melt blends. Nylon 6 copolymers may also be prepared. Preferably, a nylon 6,6 copolymer containing about 1.0 to about 4.0 weight % units derived from the sodium salt of 5-sulfoisophthalic acid is used. Another preferred copolymer is a nylon 6,6 terpolymer containing units derived from the sodium salt of 5-sulfoisophthalic acid and units derived from MPMD and isophthalic acid.

In addition, colored pigment is cofed into the extruder. The colored pigment may be added in neat form, as a mixture with "additives", or as a concentrate wherein the pigment is dispersed in a nylon polymer matrix. Suitable nylon polymer matrices include, for example, low molecular weight nylons and nylon copolymers such as nylon 6 having a weight average molecular weight of about 28,900, nylon 6/6,6/6,10 terpolymer (available from DuPont as Elvamide 8063), nylon 6,6 terpolymer containing units derived from isophthalic acid and terephthalic acid, and liquid N,N'-dialkyl polycarbonamide, such as poly(N,N-dibutylhexamethylene dodecanediamide). In a preferred case, the pigments are dispersed in nylon 6/6,6/6,10 terpolymer ("multipolymer"), and the combination is melted and resolidified to form pigmented pellets of the multipolymer. These pellets are then remelted or "let-down" in an equal or greater amount of nylon 6, mixed thoroughly to form a uniform dispersion, resolidified, and pelletized.

Polycarbonate is also cofed to the extruder. The polycarbonate may be added in neat form, as a mixture with pigments, copper concentrates, and/or "additives", or as a concentrate wherein the polycarbonate is dispersed in a nylon polymer-matrix such as the low molecular weight nylons or nylon copolymers mentioned above. The polycarbonate may be dispersed in the polymer matrix by itself or with pigments, and/or additives. Alternatively, the polycarbonate itself may be used as a polymer matrix for one or more additives.

By the term, "additives" as used herein, it is meant those materials which may be added to the polyamide melt with the pigments and polycarbonates of this invention in order to modify functional properties of the resulting fiber including, but not limited to, stabilizers, deodorants, flame retardants, delustering agents, and antimicrobial agents.

Figure 2:
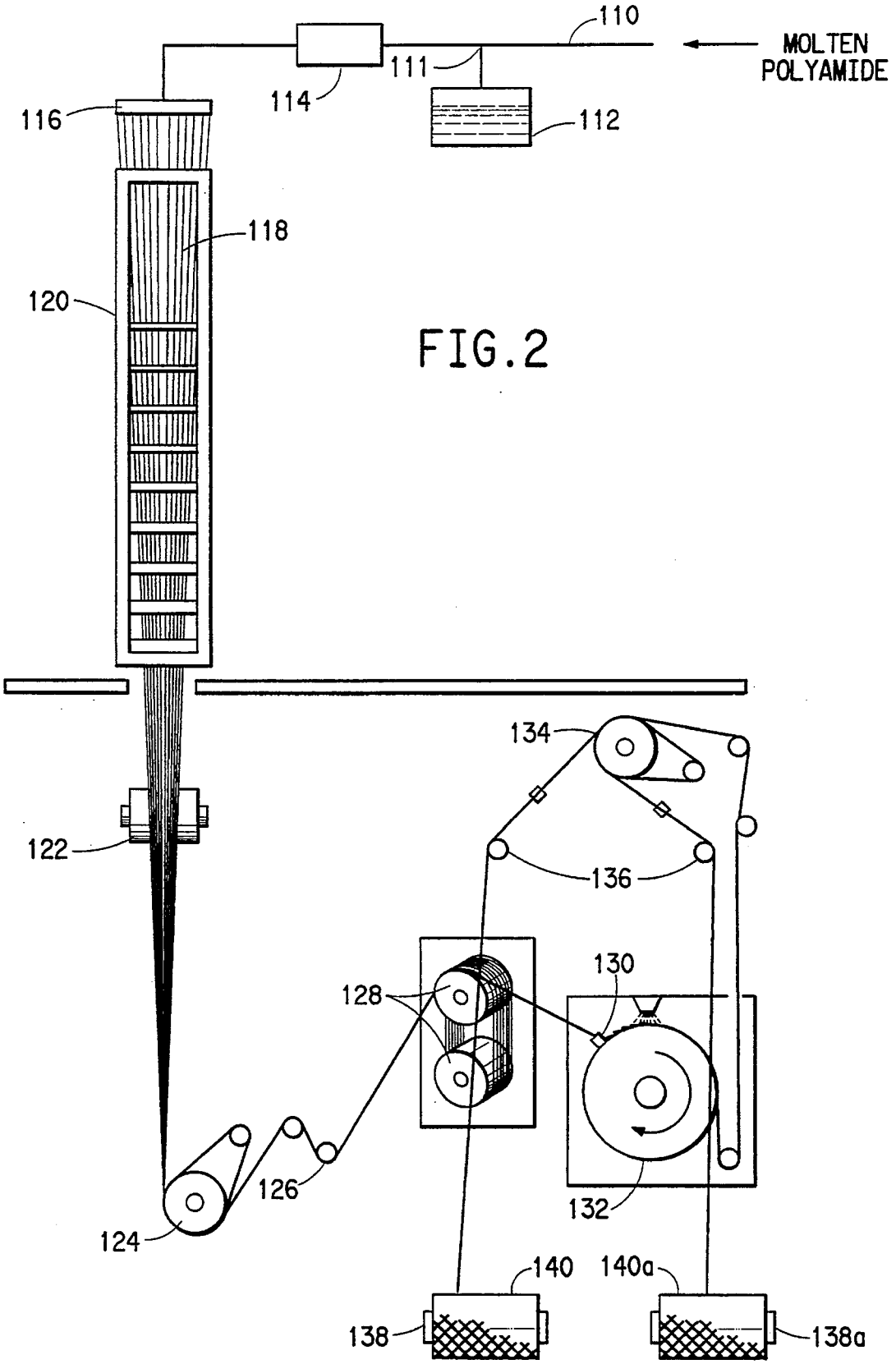
FIG. 2 is a schematic illustration of the process of this invention, wherein polycarbonate is injected into the transfer line.

An alternative embodiment of the invention is shown in FIG. 2. Molten polycarbonate from supply 112 is injected into the transfer line 110 at point 111 somewhere between the supply of fiber-forming polyamide and the mixer 114. The supply of fiber-forming polyamide may be a continuous polymerizer or an extruder (not shown). Mixer 114, which may be a dynamic mixer, a static mixer, or a combination of dynamic and static mixers, assures that the polycarbonate is well mixed with the fiber-forming polyamide prior to extruding into fiber. Pigment may be contained in the molten polyamide prior to point 111 where the polycarbonate is introduced. Alternatively, the pigment may be contained in polycarbonate supply 112, or the pigment may be separately injected into the transfer line 110 at a point not shown, but prior to mixer 114. The polycarbonate in supply 112 may be dispersed in a polymer-matrix such as a low molecular weight polyamide or a polyamide copolymer.

Polycarbonates useful in this invention have the general formula:

$$[—CO—O—R—O—]n$$

where R may be an aromatic moiety such as —Ar—, —Ar—R'—Ar—, and where n is greater than 2 and less than about 160. —Ar— represents a phenyl group or substituted phenyl group where substitution is by $—CH_3$, $—CH_2CH_3$, $—CH_2CH_2CH_3$, or diphenyl, and naphthalene. R' represents $—CH_2—$, $—(CH_3)C(CH_3)—$, $—SO_2—$, —O—, $—(CH_3)CH—$, and —S—. R can be aliphatic moieties too, such as $—CH_2CH_2—$, $—(CH_2)_3—$, $—(CH_2)_4—$, $—(CH_2)_5—$, $—(CH_2)_6—$, methylethylene, ethylpropylene, and cyclic hexylene.

Preferably, R=—ph—$C(CH_3)_2$—ph—, where ph is the phenyl group.

Preferably the number average molecular weight of the polycarbonate is between about 10,000 to about 16,000 and the weight average molecular weight is between about 20,000 to about 40,000.

Several factors influence the optimum amount of polycarbonate which should be used in order to improve the spinning process. Factors include the initial RV of the polyamide, the desired final RV, the level of polyamide amine ends, the temperature at which the polycarbonate and polyamide react, the time period in which the reaction takes place, the molecular weight of the polycarbonate, and the moisture level in the melt. For instance, only about 0.25 weight percent polycarbonate (based on total weight of the fiber-forming melt blend) is needed to increase the polyamide RV to an acceptable level for spinning when the initial RV is about 50 and the desired RV is about 60, the temperature is in the range of 280° to 295° C., and the number of amine ends is about 30 equivalents per $10^6$ grams of polymer.

In general, a minimum amount of about 0.1 weight % polycarbonate should be added to effectively increase the polyamide RV, and a maximum amount of about 3.0 weight % may be necessary. Up to about 3.0 weight % polycarbonate may be necessary to raise the polyamide RV to a desirable level when the initial RV is much lower than the final RV desired, when the level of polyamide amine ends is low, when the reaction temperature or time is low, when the polycarbonate molecular weight is high, or when the moisture level in the melt is high.

In many instances, if the melt blend contains greater than about 3 weight % polycarbonate, it is difficult to spin the melt blend into fiber, because the final polyamide RV is too high. However, it should be recognized that in some instances, it may be desirable to add the polycarbonate in an amount greater than 3 weight % depending upon the final desired polyamide RV and other factors as mentioned above.

Preferably, a sufficient amount of polycarbonate should be added to raise the polyamide RV to a final level in the range of about 50 to about 100, and more preferably the amount of polycarbonate added to the polyamide is in the range of about 0.2 to about 0.8 weight % based on total weight of the fiber-forming melt blend.

A wide variety of organic and inorganic colored pigments can be used in accordance with this invention. Examples of such pigments include Phthalo Blue R/S (PB-15:1), Perylene Red (PR-179), Idanthrone Blue (PB-60), Phthalo Green (PG-36), Yellow Chromium Complex (SY-21), and those of the Carbon Black (PBK-7) family such as Lamp Black, Furnace Black, or Channel Black. Others include Phthalo Blue (PB-15:2), Antimony-Chromium-Titanium Complex (PB-24), Iron Oxide YS and Iron Oxide BS (PR-101), Diazo Anthroquinone (PR-177), Cobalt Blue (PB-28), Carbazole Violet (PY-23), Filamid Red 3B (SR-226), Phthalo Blue G/S (PB-16) and Zinc Ferrite (PY-119). All of these pigments can be used either singly or in combinations with one another. As used herein, the term "colored pigments" is meant to exclude white pigments such as titanium dioxide which have long been used in small quantities to deluster nylon. Preferably, the pigments are added in the form of a color concentrate as described above, and the amount of color concentrate added is about 1.0 to about 10.0 weight percent based on the total weight of the fiber-forming melt blend.

The present invention is further illustrated by the following examples using the below-described test methods, but these examples should not be construed as limiting the scope of the invention.

TEST METHODS

Relative Viscosity (RV)

Dissolve 10.28 g. of yarn in 90% formic acid, and measure its relative viscosity in a automatic viscometer at 25° C. as described at column 2, lines 42–51 in Jennings, U.S. Pat. No. 4,702,875, the disclosure of which is hereby incorporated by reference.

Molecular Weight

Dissolve 20 mg. yarn in 10 ml hexafluoroisopropanol. Inject 10 ul (microliter) solution into a phenogel size exclusion column series. Flow rate is at 1.0 ml/min. at 35° C. A Waters 410 concentration detector, a continuous viscometer and laser light scattering photometer were used to analyze molecular weight.

EXAMPLES

Example 1

A random copolymer of nylon 6,6 and the sodium salt of 5-sulfoisophthalic acid was prepared by blending hexamethylene adipate salt and hexamethylene 5-sulfoisophthalate salt and polymerizing as described in Anton, U.S. Pat. No. 5,108,684. The resulting polymer contained 3 weight percent of the sodium 5-sulphoisophthalic acid.

Various color concentrates comprising pigments dispersed in a multipolymer system containing nylon 6/6,6/6,10 terpolymer (Elvamide 8063 available from DuPont) and nylon 6, as described in the following Table I, were made. These color concentrates were added to the nylon 6,6 copolymer in an extruder. At the same time, various amounts of polycarbonate (LEXAN 101 available from General Electric Co.) having a number average molecular weight of approximately 13,600 was cofed to the extruder. The temperature in the extruder was approximately 288° C. The molten mixture was pumped to a spinneret through a transfer line in approximately 5 minutes. The 128 filament hollow filament yarn was spun at 74 lb/hr. Cooling air (10° C.) was blown past the hot filaments at a flow rate of about 250 cubic ft/min. The yarn bundle was pulled from the spinneret and through the quench zone by means of a puller or feed roll, rotating at 953 yards/min. After quenching, the filaments were treated with a spin-draw finish. Next, the filaments were drawn over a pair of draw pins by a pair of draw rolls at 190° C., rotating at 2597 yards/min. The yarn filaments were heated and bulked as described in Breen and Lauterbach, U.S. Pat. No. 3,186,155. The bulking air temperature was 240° C. The final product was a 1245 denier, 19.5 denier per filament yarn. The RV of the resulting yarn was measured in a lab and reported in Table II.

TABLE I

| Concentrate | Pigment | Weight % Pigment | Weight % Nylon 6 | Weight % Nylon 6/6,6/6,10 |
|---|---|---|---|---|
| Blue | Pigment 1* | 16.27 | 61.03 | 22.70 |
| Gray | Pigment 2* | 8.95 | 81.43 | 9.62 |

| | Weight Percent |
|---|---|
| *Pigment 1 | |
| Idanthrone Blue (PB-60) | 5.33% |
| Phthalo Blue R/S (PB-15:1) | 8.10% |
| Channel Black | 2.84% |
| *Pigment 2 | |
| Phthalo Blue R/S (PB-15:1) | 0.26% |
| Yellow Chromium Complex (SY-21) | 0.64% |
| Lamb Black | 4.60% |
| Anatase $TiO_2$ | 3.45% |

TABLE II

| Item | Concentrate | Weight % Concentrate | Weight % Polycarbonate | RV |
|---|---|---|---|---|
| C8 (control) | — | 0.0 | 0.00 | 63.3 |
| C19 (control) | Blue | 3.0 | 0.00 | 50.3 |
| C20 | Blue | 3.0 | 0.10 | 54.7 |
| C21 | Blue | 3.0 | 0.25 | 55.6 |
| C22 | Blue | 3.0 | 0.50 | 66.3 |
| C15 (control) | Gray | 3.0 | 0.00 | 52.6 |
| C16 | Gray | 3.0 | 0.10 | 53.4 |
| C17 | Gray | 3.0 | 0.25 | 58.5 |

Without polycarbonate, the RV (and thus the molecular weight of the polymer) dropped from 63.3 to 50.3 when the color concentrate, Blue, was added and from 63.3 to 52.6 when the color concentrate, Gray was added. In both of these instances, there were numerous filament breaks during the spinning operation. Addition of polycarbonate raised the RV sufficiently so that spinning processability improved and only a small amount of filament breaks were observed.

Example 2

The same nylon 6,6 copolymer which was used in Example 1 was used in this Example. Rather than adding polycarbonate to the extruder separately as done in Example 1, polycarbonate was compounded into the color concentrate as the color concentrate was being made. Polycarbonate (LEXAN 101) having an approximate number average molecular weight of 13,600 was used in this Example. Color concentrates comprising the polycarbonate and various pigments dispersed in a multipolymer system of nylon 6/6,6/6,10 terpolymer (Elvamide 8063 available from DuPont) and nylon 6, as described in the following Table III, were made.

The color concentrate and nylon copolymer were cofed into an extruder. The temperature of the extruder was maintained at approximately 288° C. The resulting molten polymer was extruded through a spinneret into fibers as done in Example 1. The fiber RV values are reported in Table IV.

TABLE III

| Pigment | BLUE COLOR CONCENTRATE CONTAINING POLYCARBONATE | | | |
|---|---|---|---|---|
| | Weight % Pigment | Weight % Nylon 6 | Weight % Nylon 6/6,6/6,10 | Weight % Polycarbonate |
| Pigment 1* | 16.27 | 53.33 | 22.70 | 7.70 |
| Pigment 1* | 16.27 | 46.73 | 22.7 | 14.30 |

Pigment 1* - The pigment formulation for this Example was the same as the Pigment 1 formulation used in Example 1 as further described in Table I.

TABLE IV

| Item | Weight Percent Color Concentrate | Resultant Weight Percent Polycarbonate in Fiber | RV |
|---|---|---|---|
| D1 (control) | 0.0 | 0.00 | 54.0 |
| D8 | 3.0 | 0.23 | 52.4 |
| D9 | 3.0 | 0.43 | 69.1 |

This Example 2 illustrates one of the embodiments of this invention wherein the polycarbonate is contained in the color concentrate, rather than adding the polycarbonate separately. Fiber spinning quality was good for the two items which contained polycarbonate.

We claim:

1. A process for producing colored nylon fiber, comprising the steps of:

a) forming a fiber-spinnable melt blend comprising nylon polymer, pigment, and about 0.2 to about 0.8 weight percent polycarbonate based on the weight of the melt blend, and b) extruding the melt blend through a spinneret to form colored nylon fiber.

2. The process of claim 1, wherein the nylon polymer is selected from the group consisting of nylon 6,6 homopolymer, nylon 6 homopolymer, nylon 6,6/6 copolymers, sulfonated nylon 6,6 or nylon 6 copolymer containing units derived from an aromatic sulfonate or an alkali metal salt thereof, and nylon 6,6 or nylon 6 copolymer containing units derived from 2-methyl-pentamethylenediamine and isophthalic acid.

3. The process of claim 2, wherein the nylon polymer is a nylon 6,6 copolymer containing units derived from the sodium salt of 5-sulfoisophthalic acid, and wherein the pigment is added in the form of a color concentrate, said concentrate comprising pigment dispersed in a nylon polymer matrix.

4. The process of claim 3, wherein the nylon 6,6 copolymer contains about 1.0 to about 4.0 weight percent units derived from the sodium salt of 5-sulfoisophthalic acid.

5. The process of claim 3, wherein the pigment is dispersed in a nylon 6/6,6/6,10 copolymer matrix and the melt blend comprises about 1.0 to about 10.0 weight percent color concentrate.

6. The process of claim 1, wherein the polycarbonate is added in the form of a concentrate, said concentrate comprising polycarbonate dispersed in a nylon polymer matrix.

7. The process of claim 6, wherein the polycarbonate concentrate further comprises pigment dispersed in the nylon polymer matrix.

* * * * *